US008960298B2

(12) United States Patent
Hill, Jr. et al.

(10) Patent No.: US 8,960,298 B2
(45) Date of Patent: Feb. 24, 2015

(54) DEEP SET SUBSURFACE SAFETY SYSTEM

(71) Applicant: Tejas Research and Engineering, LLC, The Woodlands, TX (US)

(72) Inventors: Thomas G. Hill, Jr., Conroe, TX (US); Robert C. Henschel, The Woodlands, TX (US)

(73) Assignee: Tejas Research and Engineering, LLC, The Woodlands, TX (US)

( * ) Notice: Subject to any disclaimer, the term of this patent is extended or adjusted under 35 U.S.C. 154(b) by 200 days.

(21) Appl. No.: 13/752,762

(22) Filed: Jan. 29, 2013

(65) Prior Publication Data

US 2013/0199791 A1 Aug. 8, 2013

Related U.S. Application Data

(60) Provisional application No. 61/593,927, filed on Feb. 2, 2012.

(51) Int. Cl.
*E21B 34/06* (2006.01)

(52) U.S. Cl.
CPC ..... *E21B 34/06* (2013.01)
USPC ..... 166/332.8

(58) Field of Classification Search
USPC ..... 166/332.1, 332.8, 334.1
See application file for complete search history.

(56) References Cited

U.S. PATENT DOCUMENTS

| | | | | |
|---|---|---|---|---|
| 6,237,693 | B1 | 5/2001 | Deaton | |
| 6,619,388 | B2 * | 9/2003 | Dietz et al. | 166/66.7 |
| 7,640,989 | B2 * | 1/2010 | Williamson et al. | 166/332.8 |
| 7,971,652 | B2 * | 7/2011 | Tanju | 166/373 |
| 2009/0250206 | A1 | 10/2009 | Lake et al. | |
| 2010/0108324 | A1 | 5/2010 | Tanju | |
| 2011/0186303 | A1 | 8/2011 | Scott et al. | |

* cited by examiner

*Primary Examiner* — William P Neuder
(74) *Attorney, Agent, or Firm* — John J. Love; Claude E. Cooke, Jr.; Cooke Law Firm

(57) ABSTRACT

A subsurface safety valve is operable to close a fluid flow path by virtue of an axially movable flow sleeve. The valve includes a recockable linear actuator and a latch mechanism so that the valve can be moved from an open to a closed position as a result of axial movement of the flow sleeve without overcoming the pressure head and frictional forces currently encountered in conventional safety valves.

5 Claims, 6 Drawing Sheets

DEEP SET SUBSURFACE SAFETY SYSTEM

This application claims priority to U.S. Provisional Application Ser. No. 61/593,927 with a filing date of Feb. 2, 2012.

BACKGROUND OF INVENTION

1. Field of the Invention

This application is directed to a subsurface safety valve system for use in drilling oil or gas wells. Such valves are commonly used to prevent flow of oil or gas from the well to the surface when certain conditions occur.

2. Description of Related Art

Currently such safety valves are held in an open position by virtue of pressure in a control line from the surface acting on a piston in the valve which is operatively connected to a flow sleeve which moves axially to open a valve member. Movement of the sleeve also compresses a spring surrounding the flow sleeve.

Upon the occurrence of an unfavorable event, the pressure is relieved via the control line so that the spring will move the flow sleeve upwardly so as to allow the valve, which may be a flapper valve as shown in FIG. 2 of this application to close. In so doing, the spring must overcome the pressure head caused by the hydraulic fluid and the flow resistance due to the small diameter of the control line.

Some control lines in deep water subsea wells may be up to two miles or more in length and may extend a vertical distance of more than a mile.

Consequently the pressure head and resistance to flow is quite high which can delay the response time for the valve and may in some cases result in failure.

BRIEF SUMMARY OF THE INVENTION

The above mentioned design defects are overcome by the current invention. A recockable actuator is located within the valve body that is not subject to the pressure head or flow line resistance to move the flow sleeve to open the valve. When the flow sleeve is moved to a position which opens the valve, a latching mechanism engages the flow sleeve to hold it in place and the actuator is disengaged from the flow sleeve. To close the valve, the latch mechanism is disengaged and the flow sleeve will move upwardly by virtue of the compressed spring without having to overcome the pressure head or fictional forces.

BRIEF DESCRIPTION OF THE SEVERAL VIEWS OF THE DRAWING(S)

DETAILED DESCRIPTION OF THE INVENTION

Figure 1:
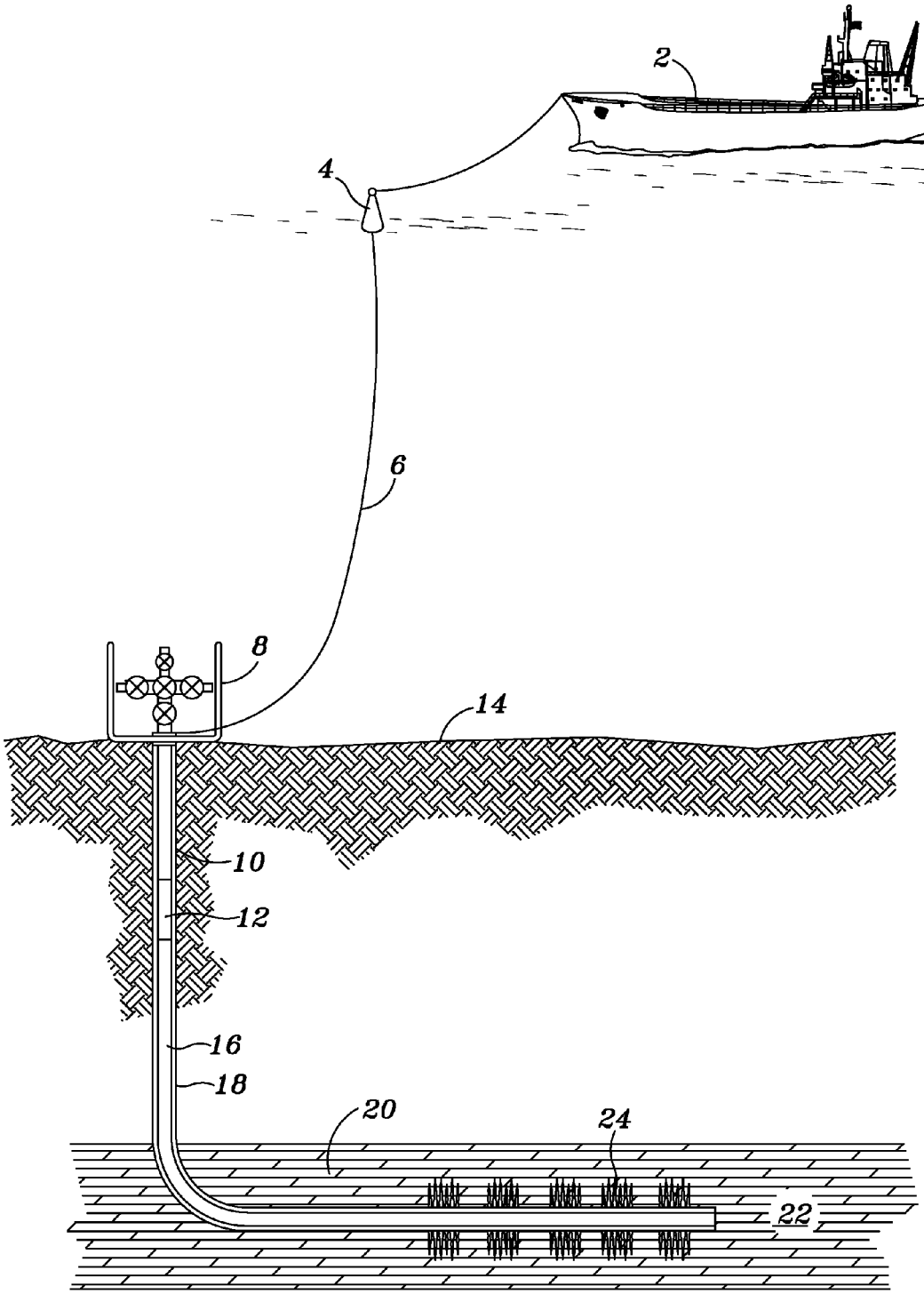
FIG. 1 is a schematic diagram of a typical off shore producing oil well.

FIG. 1 illustrates a typical deep water, producing well system. A floating production, storage, and offload ship 2 is tethered to a buoy 4. Production tubing 6 extends from the buoy to the sea floor 14 and runs to the well head 8. The well includes casing 18 and production tubing 16 which may extend vertically and then is directed horizontally through the production zone 20 of formation 22. Perforations 24 may be formed in the formation.

A safety valve 12 is typically located in the production 12 tubing 16 between the well head 8 and the producing zone 20. A control line 10 extends from the surface vessel to valve 12.

Figure 2A:
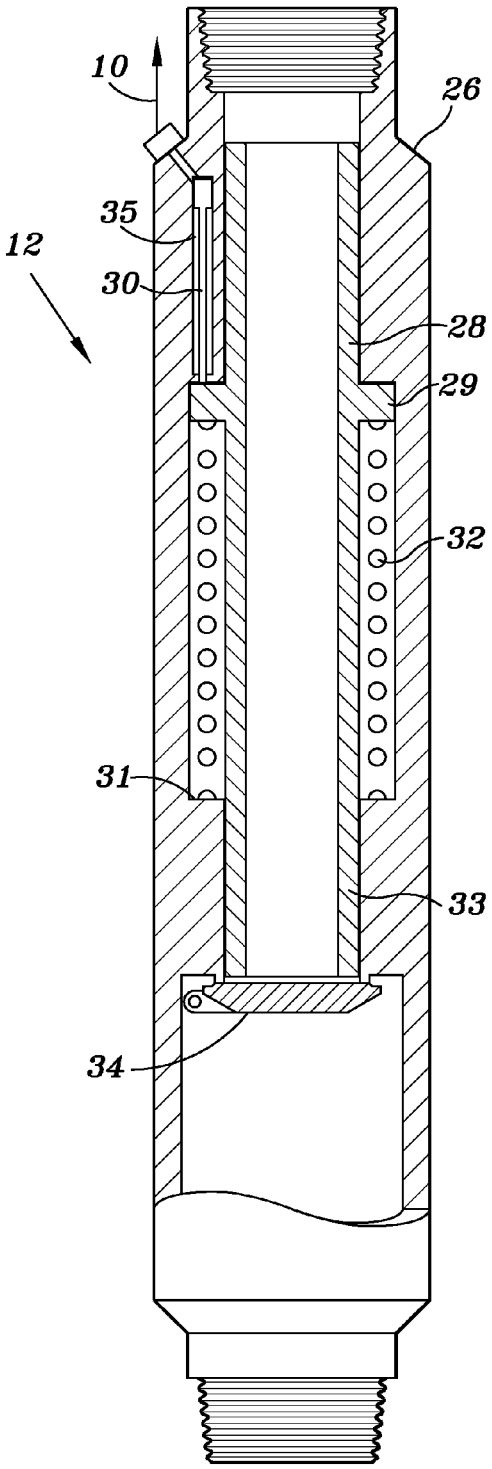
PRIOR ART FIG. 2A
FIGS. 2A and 2B are cross-sectional views of a conventional safety valve in the close and open position, respectively.

FIG. 2A illustrates a typical known valve 12 which includes a valve body 26 having threaded connection points at each end. An axially movable flow sleeve 28 having an annular shoulder 29 is located within the valve body. A piston 30 has its upper portion located in a pressure chamber 35 which is coupled to a hydraulic pressurized control line 10 as is known in the art. A spring 32 is captured between shoulder 29 and a shoulder 31 formed within the valve body. A flapper valve 34 is pivotably mounted at a lower portion of the valve body and is biased to the closed position shown in FIG. 2A by a coil spring.

Figure 2B:
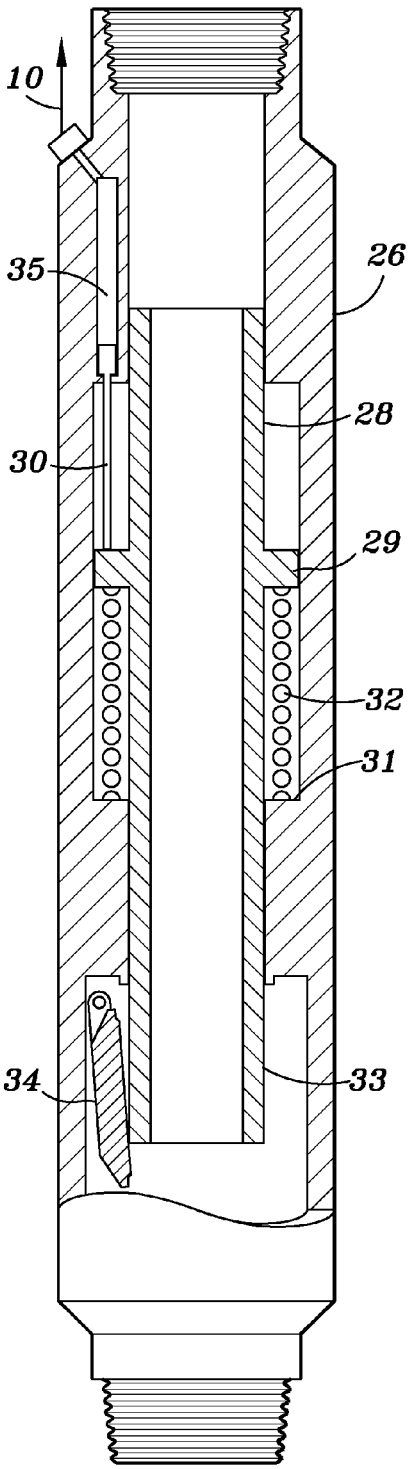
PRIOR ART FIG. 2B

In order to open the valve, fluid under pressure is conveyed by control line 10 to the pressure chamber 35 above piston 30 which moves downwardly and engages shoulder 29 of flow sleeve 28. Flow sleeve in turn moves downwardly while compressing spring 32 and the lower end 33 of the flow sleeve will open valve 34 as shown in FIG. 2B.

To close the valve, pressure within control line 10 is relieved and spring 32 will force flow sleeve 28 in an upward direction thus allowing the valve member to close. While moving upward, the flow sleeve 28 must overcome the pressure head and flow resistance associated with control line 10.

Figure 3A:
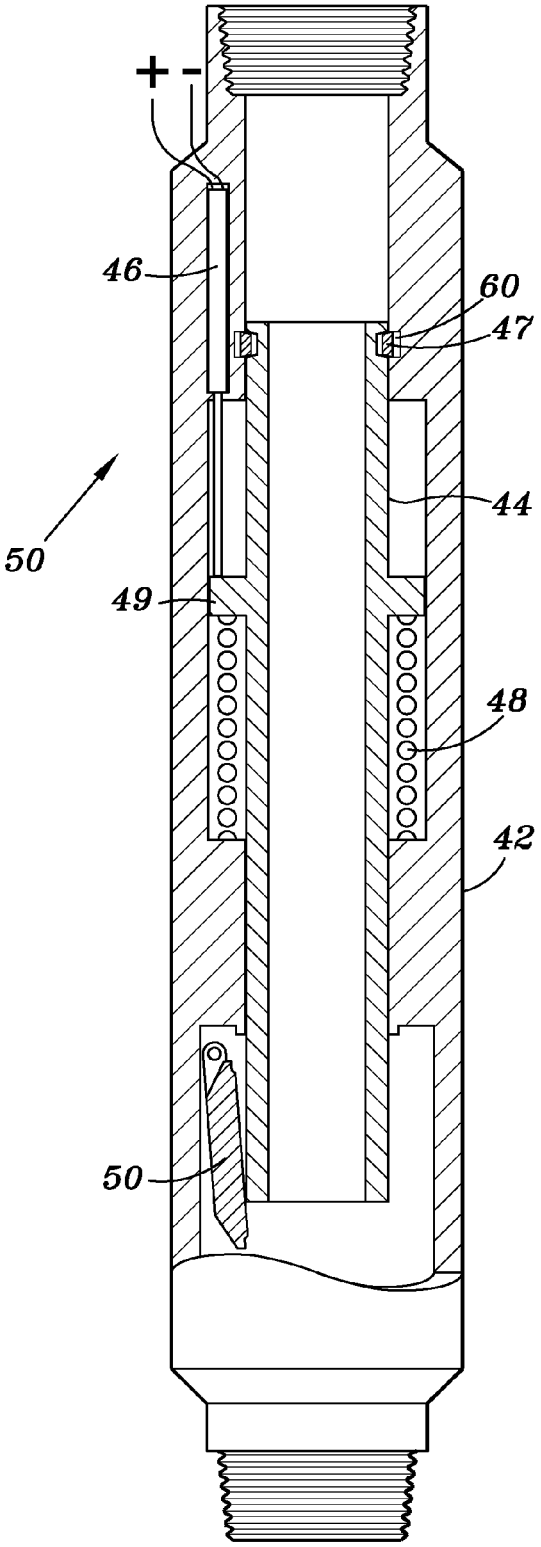
FIGS. 3A and 3B are cross-sectional views of an embodiment of a recockable actuator and latch mechanism according to the invention in an open and closed position, respectively.

An embodiment according to the invention is shown in FIG. 3A. The valve 40 is similar to that shown in FIG. 2A and includes a valve body 42, flow sleeve 44, spring 48, shoulder 49, and biased valve 50. However, in lieu of a pressure operated piston, a recockable actuator 46 is provided for axially moving flow sleeve 44. Actuator 46 may be a motorized electric linear actuator, as is well known in the art. The valve body 42 is provided with a latching mechanism shown at 47 in FIG. 3B. Latching mechanism 47 locks flow sleeve 44 in place against axial movement in the open position shown in FIG. 3A.

The latching mechanism may be a semi-circular split ring 47 as shown in FIG. 7 formed of a shape memory alloy (SMA) positioned within an annular groove 60 provided in the interior surface of valve body 42. An annular groove 61 may be provided on the outer periphery of the upper portion of flow sleeve 44. As the flow sleeve is moved downwardly by the recockable mechanism 46, the groove 61 on the outer surface of sleeve 44 is brought into registry with the shape memory alloy ring. Energizing the ring by completion of an electrical circuit connected to the ring will cause the ring to partially contract into the annular groove on the outer surface of the flow sleeve, thus latching or locking the flow sleeve in place with valve 50 in the open position as shown in FIG. 3A. At this point linear activator 46 can be backed off from shoulder 49 by reversing the motor actuator.

Figure 3B:
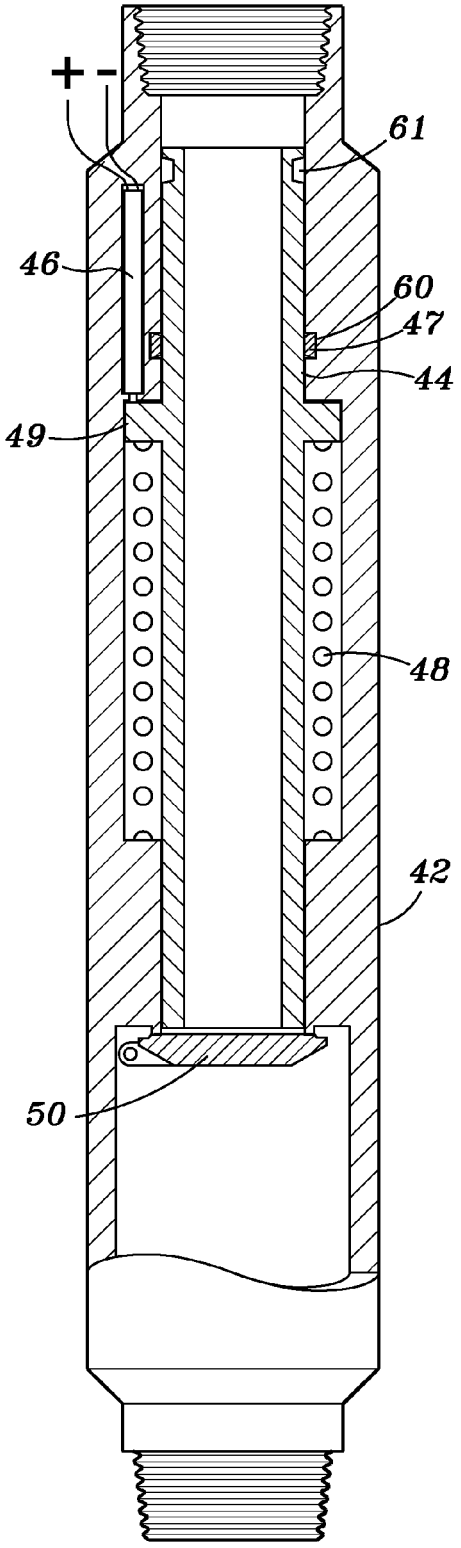

In order to close the valve, the SMA split ring is de-energized so that it no longer partially occupies the groove 61 in the outer surface of the flow sleeve. At this point compressed spring 48 will move flow sleeve 44 in an upward direction past valve 50 so that the spring biased valve 50 will now move to the closed position as shown in FIG. 3B. However since the recockable actuator 46 is not mechanically linked to the flow sleeve, movement of the flow sleeve will not be retarded.

Figures 4A, 4B:
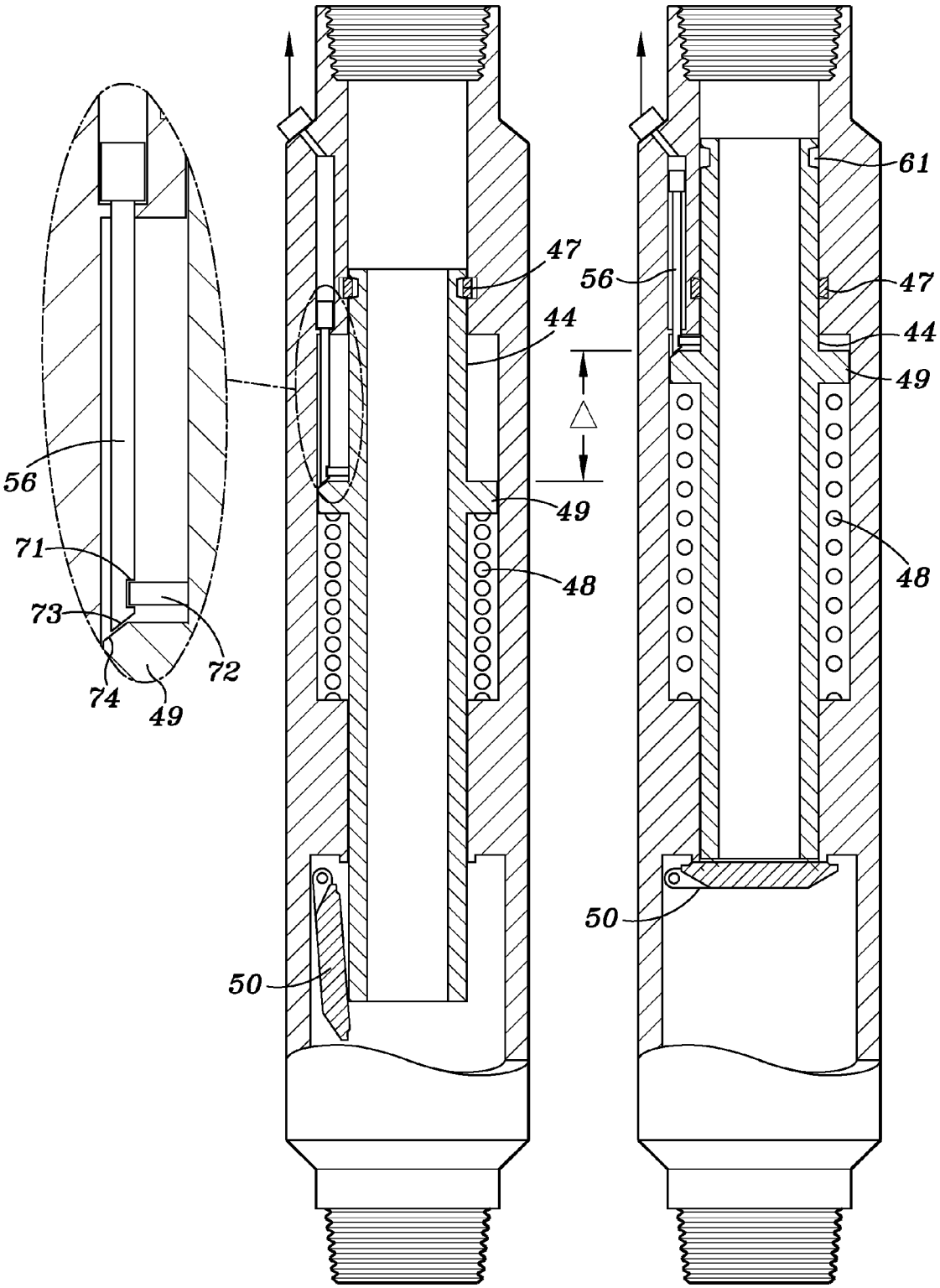
FIGS. 4A and 4B are further embodiments of a recockable actuator and latch mechanism according to the invention in an open and closed position, respectively.

FIGS. 4A and 4B illustrate yet another embodiment of the invention. In this embodiment, a hydraulically activated piston 56 moves flow sleeve 44 so as to open valve 50 and disengages by virtue of a tilting mechanism as the flow sleeve reaches its lowermost position. Tilting mechanism includes a notch 71 formed in the piston 56 and a tab 72 that loosely is received within notch 71. A beveled surface 73 is formed at the end of piston 56 which cooperates with a beveled surface 74 on shoulder 49 of the flow sleeve. As surfaces 73 and 74 engage at the lower portion of flow sleeve 44 shown in FIG. 4A, piston 56 tilts sideways such that tab 72 is no longer located within notch 71. As in previous embodiments SMA ring 47 may be used to latch and unlatch the flow tube.

Figures 5A, 5B:
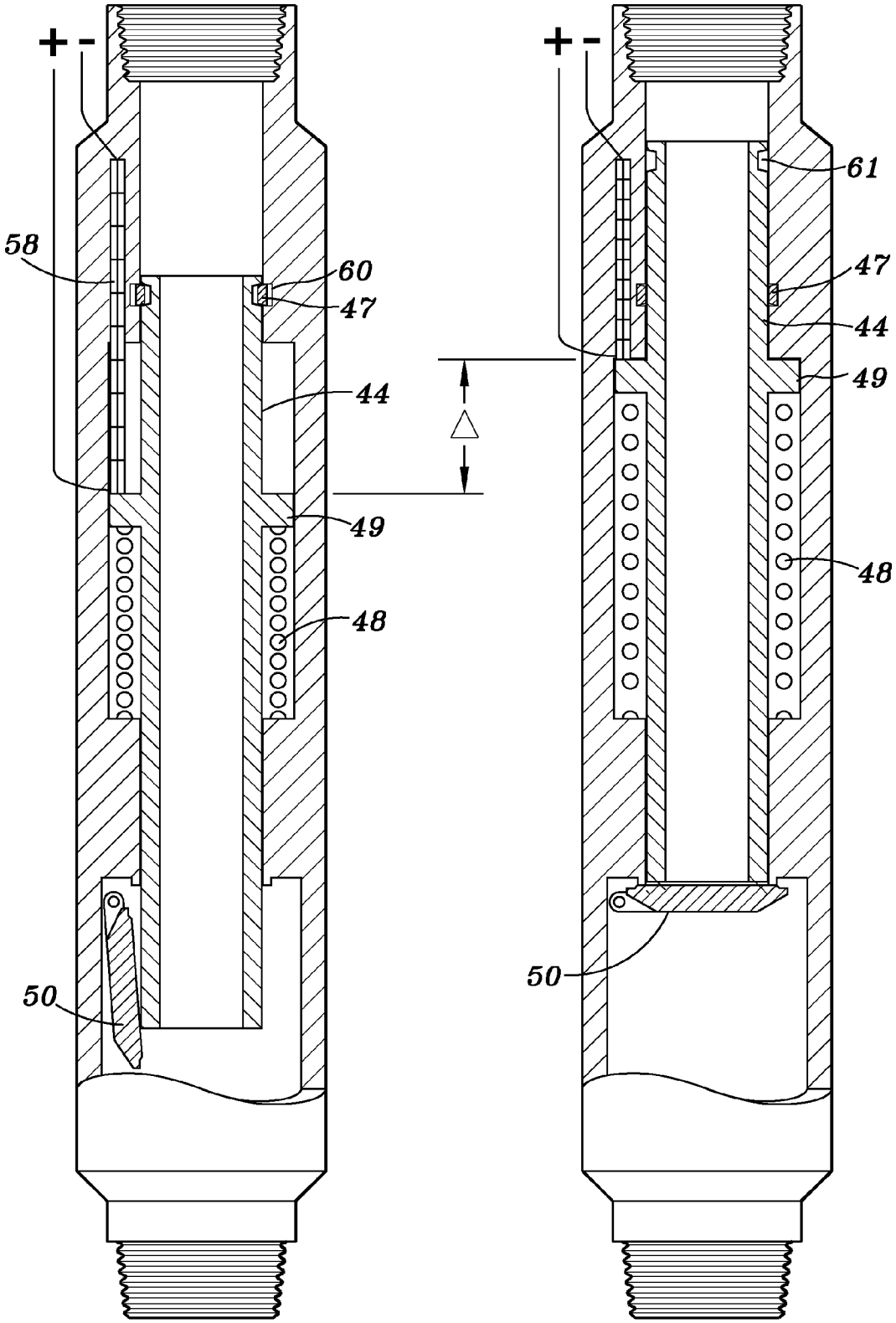
FIGS. 5A and 5B are another embodiment of a recockable actuator and latch mechanism according to the invention in the open and closed position.
Figure 6:
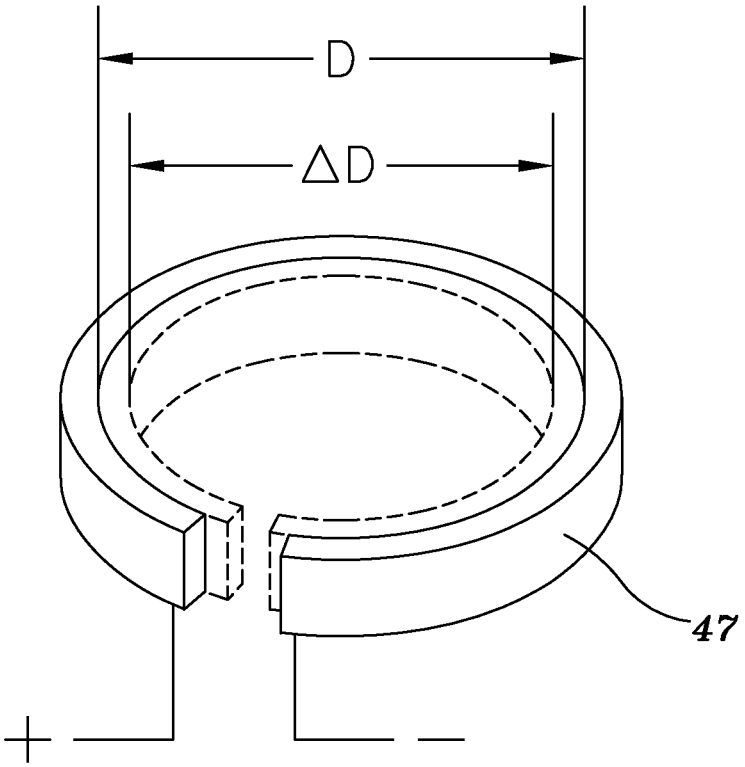
FIG. 6 is a view of an embodiment of a latch mechanism according to the invention.

FIGS. 5A and 5B illustrate a further embodiment of the invention. According to this embodiment the actuator comprises a shape memory alloy linear actuator 58 commonly referred to as a SMA muscle. When energized, SMA actuator 58 will expand thus moving flow sleeve 44 downwardly to open valve 50. As the flow sleeve reaches its lowermost position, SMA ring is activated to move partially into annulus recess 61 on the outer surface of flow sleeve 44 as shown in FIG. 5A in the valve open position. Linear SMA actuator is de-energized to decouple the actuator 58 from the flow sleeve. In order to close the valve, SMA ring 47 is de-energized so that it withdraws from groove 61 and compressed spring 48 will move flow sleeve 44 upwardly as shown in FIG. 5B in the closed position.

Latch mechanisms may take various forms, for example it could be a piston member that is radially actuated to engage a slot on the outer surface of the flow sleeve. Other well-known latching mechanism may also be utilized.

Other embodiments include:

1) All hydraulic solution: a fit for purpose all-hydraulic Surface Controlled Subsurface Safety Valve, designed with no gas charge, adapted to close more rapidly than currently available products.

2) Hydraulic-Electric solution: A fit for purpose Hydraulic Electric solution for a Surface Controlled Subsurface Safety Valve, having a (low voltage/amperage) electrically activated and deactivated latching and unlatching device, and adapted to close virtually instantaneously upon loss of current. Further, the valve would contain a separate hydraulic recocking mechanism, to open and rearm the valve. The valve would have a much longer design life, higher cyclic integrity and therefore higher reliability than known products.

3) All Electric Solution: A fit for purpose Hydraulic Electric solution for a Surface Controlled Subsurface Safety Valve, designed with (low voltage/amperage) electrically activated and deactivated latching and unlatching device, and adapted to close virtually instantaneously upon loss of current. Further, the valve would contain a separate electrically energized recocking mechanism, to open and rearm the valve. The valve would have a much longer design life, higher cyclic integrity and therefore high reliability than known products.

4) All Electric-Hydraulic redundant Solution: A fit for purpose Hydraulic Electric solution for a Surface Controlled Subsurface Safety Valve, designed with (low voltage/amperage) electrically activated and deactivated latching and unlatching device, and adapted to close virtually instantaneously upon loss of current. The valve would contain a separate electrically energized recocking mechanism. Further, the valve would contain a separate and redundant hydraulically energized recocking mechanism to open and rearm the valve. Both the hydraulic and electric recocking mechanism would be independent and redundant. The valve would have a much longer design life, higher cyclic integrity and therefore higher reliability than known products.

Although the present invention has been described with respect to specific details, it is not intended that such details should be regarded as limitations on the scope of the invention, except to the extent that they are included in the accompanying claims.

I claim:

1. A safety valve comprising:

a) a body, b) a flow sleeve positioned within the body and axially movable, c) a valve element pivotably mounted within the body between an open and closed position, d) a recockable actuator within the body for moving the flow sleeve in an axial direction, and disengaging from the flow sleeve when the valve is in the open position, e) a latching mechanism for locking and unlocking the flow sleeve in a given position; and f) wherein the latching mechanism comprises an annular groove on an outside surface of the flow sleeve and a split ring formed of a shape memory alloy that contracts partially into the groove when activated.

2. A safety valve as claimed in claim 1 wherein the recockable actuator comprises a motorized electric linear actuator.

3. A safety valve as claimed in claim 1 wherein the recockable actuator comprises a shape memory alloy linear actuator.

4. A safety valve as claimed in claim 1 wherein the flow sleeve includes a shoulder, and a spring captured between the shoulder and a second shoulder located within the valve body.

5. A safety valve as claimed in claim 1 wherein the split ring is positioned within the valve body.

* * * * *